United States Patent [19]

Di Martini et al.

[11] 4,333,762

[45] Jun. 8, 1982

[54] LOW TEMPERATURE, NON-$SO_2$ POLLUTING, KETTLE PROCESS FOR THE SEPARATION OF ANTIMONY VALUES FROM MATERIAL CONTAINING SULFO-ANTIMONY COMPOUNDS OF COPPER

[75] Inventors: Carl R. Di Martini, Piscataway, N.J.; William L. Scott, Tampa, Fla.; Leo J. Bulvanoski, Fords, N.J.

[73] Assignee: Asarco Incorporated, New York, N.Y.

[21] Appl. No.: 132,240

[22] Filed: Mar. 20, 1980

[51] Int. Cl.[3] ..... C22B 30/02

[52] U.S. Cl. ..... 75/69; 75/21; 75/77

[58] Field of Search ..... 75/69, 77, 88, 76, 21, 75/23

[56] References Cited

U.S. PATENT DOCUMENTS

| | | | |
|---|---|---|---|
| 438,117 | 10/1890 | Shapleigh | 75/77 |
| 714,040 | 11/1902 | Crisp | 75/69 |
| 807,271 | 12/1905 | Imbert | 75/77 |
| 1,428,041 | 9/1922 | Kroll | 75/69 |
| 1,662,439 | 3/1928 | Rose | 75/69 |
| 1,778,019 | 10/1930 | Blaylock | 75/69 |
| 1,886,938 | 11/1932 | Brett | 75/77 |
| 1,925,687 | 9/1933 | Cohn | 75/77 |
| 2,062,838 | 1/1936 | Skow | 75/78 |
| 2,278,134 | 3/1942 | Osborn | 75/69 |
| 2,834,669 | 5/1958 | Pandar | 75/77 |
| 3,160,856 | 2/1965 | Stolbert | 75/88 |
| 3,969,202 | 7/1976 | Albrethsen | 75/69 |

*Primary Examiner*—P. D. Rosenberg

[57] ABSTRACT

Antimony values are separated from a material containing a sulfo-antimony compound of copper, e.g. tetrahedrite ore concentrate, by a process involving establishing a pool of molten lead, adding a metallic alkali metal, e.g. metallic sodium, to the molten lead in an amount which is sufficient to reduce the combined antimony of the sulfo-antimony compound or compounds of copper of the tetrahedrite to metallic antimony, adding the tetrahedrite ore concentrate to the molten lead, and mixing together the alkali metal, molten lead, and tetrahedrite ore concentrate. The alkali metal and sulfo-antimony compound of copper are reacted together in the presence of the molten lead for a period which is sufficient to reduce the antimony of the sulfo-antimony compound of copper to metallic antimony and to form one or more sulfo-alkali metal compounds of copper, and a matte phase which separates from the molten lead. The reduced, metallic antimony passes into the molten lead pool, and the sulfo-alkali metal compound or compounds of copper report in the matte phase on the surface of the molten lead pool. The matte phase is separated from the molten lead. The metallic antimony is then recovered from the lead. Alternatively, if lead- and antimony-containing alloy is desired as a product, the antimony is retained in the lead, and additional antimony and/or lead may or may not be incorporated into the alloy, as desired or required, to obtain the desired alloy composition. Should the alloy product be a desired product, the starting lead of the molten pool will ordinarily not be a liquated, rough drossed lead bullion, but instead another lead such as, for example pure lead or antimonial lead. The process herein is a relatively low temperature process employing temperatures of the molten lead pool above the melting point of lead but ordinarily not in excess of 650° C. Further, the instant process does not require a smelting furnace but is ordinarily carried out in a kettle.

12 Claims, 1 Drawing Figure

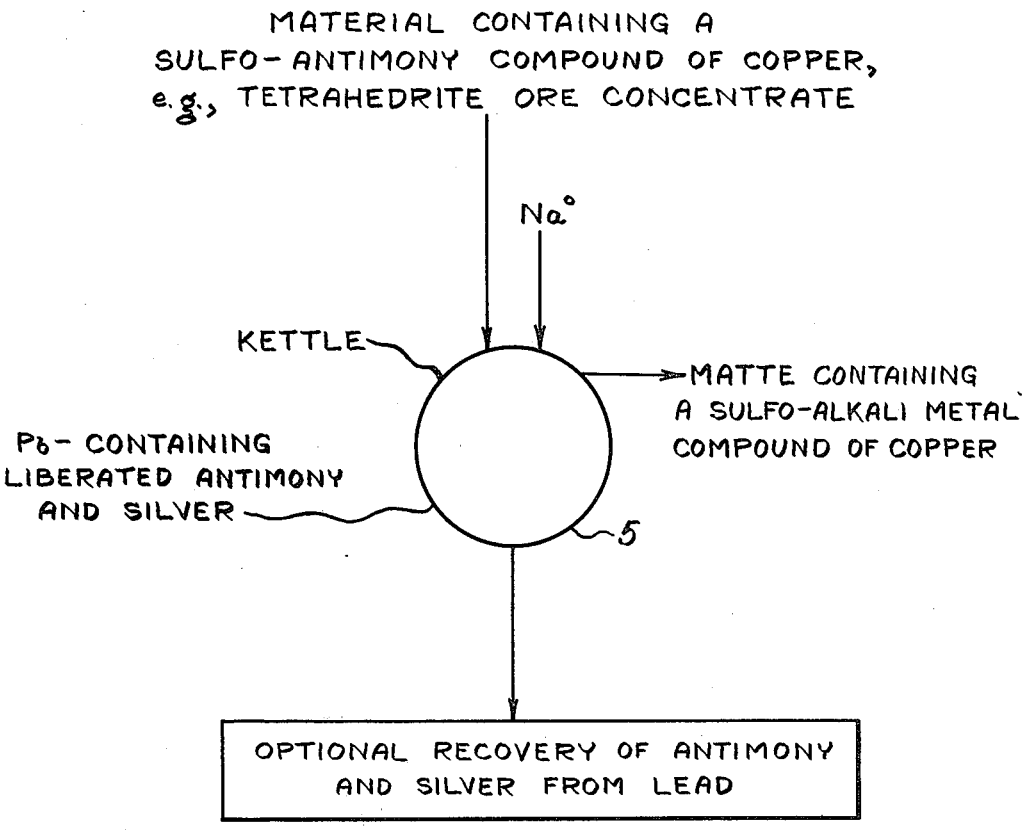
MATERIAL CONTAINING A
SULFO-ANTIMONY COMPOUND OF COPPER,
e.g., TETRAHEDRITE ORE CONCENTRATE
Na°
KETTLE
MATTE CONTAINING
A SULFO-ALKALI METAL
COMPOUND OF COPPER
Pb- CONTAINING
LIBERATED ANTIMONY
AND SILVER
5
OPTIONAL RECOVERY OF ANTIMONY
AND SILVER FROM LEAD

LOW TEMPERATURE, NON-$SO_2$ POLLUTING, KETTLE PROCESS FOR THE SEPARATION OF ANTIMONY VALUES FROM MATERIAL CONTAINING SULFO-ANTIMONY COMPOUNDS OF COPPER

1. STATEMENT OF THE INVENTION

This invention relates to the recovery of antimony values and more particularly to a process for the recovery of antimony values from material containing a sulfo-antimony compound of copper such as, for example, tetrahedrite ore concentrate.

2. DESCRIPTION OF THE PRIOR ART

U.S. Pat. No. 714,040 relates to the high temperature smelting of antimony ores for the production of metallic antimony wherein antimony sulfide ore is immersed in a molten bath of iron sulfide in preferably a reverberatory furnace, a reducing agent, such as metallic iron, for reducing the antimony ore is added, and metallic antimony is tapped off. The prior art smelting process may generate polluting $SO_2$ or other obnoxious fumes or vapors. U.S. Pat. No. 1,778,019 relates to a process for recovering gold, silver and lead from roasted or oxidized antimony ores, antimonial flue dust and antimonial by-products, involving admixing lead with the antimonial charge in such proportions that the silver content of the charge does not exceed 2.25 parts for every one hundred parts of the contained lead over and above the lead required for the gold, and the gold content does not exceed 4 parts for every one hundred parts of the contained lead over and above the lead required for the silver. Carbonaceous material and soda ash are further admixed with the antimonial charge for reducing the charge, and the resulting reduced metal is cast into a block surrounded by heat insulating material whereby the block solidifies slowly and the contained metals therein segregate into two fractions, an outer fraction containing antimony metal substantially free of gold, silver and lead, and an inner fraction containing the major portion of the gold, silver and lead. U.S. Pat. No. 2,062,838 discloses a process for recovering antimony or antimony compounds from copper-bearing antimonial lead, involving cooling the withdrawn, residual metal remaining after the volatilization of antimony oxide from copper-bearing antimonial lead and having a copper content in excess of 8%, to separate most of the copper as a high copper-content dross, fuming the dross to produce antimony oxide, an antimonial slag and metal of high copper content, recycling the antimonial slag for concentration of its antimony content, and further cooling the withdrawn residual metal to yield a high antimony dross for recycling for volatilization of antimony oxide.

BRIEF SUMMARY OF THE INVENTION

The process of the present invention involves establishing a pool of molten lead, adding metallic alkali metal, e.g. metallic sodium, to the molten lead pool, and adding the material containing the sulfo-antimony compound or compounds of copper, e.g. tetrahedrite ore concentrate or ore, to the molten lead pool. The alkali metal is added to the molten lead in an amount sufficient to reduce at least a significant portion, and usually at least a major portion, i.e. more than 50%, substantially all or all of the combined antimony of the sulfo-antimony compound of copper to zero valent, elemental antimony. The metallic alkali metal, molten lead and sulfo-antimony compound of copper are mixed together, and the metallic alkali metal reacts with the sulfo-antimony compound of copper to reduce the antimony of the sulfo-antimony compound of copper to zero valent, elemental antimony, and also form one or more sulfo-alkali metal compounds of copper. A matte phase separates from the molten lead. The liberated metallic antimony passes into the molten lead pool, and the sulfo-alkali metal compound of copper reports in, i.e. passes into, the matte phase. The matte phase containing the sulfo-alkali metal compound of copper is separated from the molten lead containing the liberated antimony. The elemental antimony can then, if desired, be separated from the lead.

The process herein is characterized by (1) being a low temperature process as compared with the prior art high temperature smelting process requiring temperatures in excess of 1090° C.; (2) being a so-called kettle process capable of being carried out in a kettle which is usually a steel kettle of the type ordinarily found in a lead refinery and not requiring the employment of a costly smelting furnace such as a reverberatory or blast furnace; (3) being an autogenous or substantially autogenous process requiring at most little external heat addition after the reaction has commenced due to the exothermic nature of the reaction; (4) economy and efficiency; and (5) not generating air-polluting $SO_2$ and not generating S-containing emissions and consequently no expensive acid plant is required to deal with $SO_2$ and no plant or special equipment is required for treating S-containing emissions to recover S.

By the term "kettle" as used herein is meant any suitable vessel, receptacle, container or reactor, exclusive of a smelting furnace such as a reverberatory furnace or blast furnace, and usually the steel kettle of the type ordinarily found and utilized in a lead refinery for refining lead.

If lead-and antimony-containing alloy is a desired product, the antimony is retained in the lead, and additional antimony and/or lead may be incorporated into the alloy, as desired or required, to obtain the desired alloy composition. Should the alloy be the desired product, the lead of the molten pool in the process of this invention is ordinarily not a liquated, rough copper-drossed lead bullion, but instead another lead such as, for example, pure or substantially pure lead or antimonial lead. If antimony-containing alloy is the desired product and a liquated, rough copper-drossed lead bullion is the feed for forming the molten lead pool in the process herein, silver, arsenic and copper may have to be removed from the lead by conventional methods prior to forming the lead pool.

The liberated, reduced antimony can be recovered from the molten lead by a procedure which comprises contacting the molten lead containing the molten antimony at an elevated temperature of typically about 600°–700° C. or somewhat higher with a stream of free oxygen-containing gas, e.g. air, through a lance or other means for a period sufficient to oxidize a major portion, i.e. more than 50%, or all or substantially all of the antimony and a portion of the metallic lead, ordinarily a small portion of the lead, to oxides of antimony, and of lead, ordinarily $Sb_2O_3$ and PbO. The oxides of antimony and lead report in a slag which separates from the molten lead. The antimony oxide- and lead oxide-containing slag is separated from the molten lead, usually by skimming. The separated oxide-containing slag is then charged into a suitable furnace, for example a cupola furnace, and a reducing agent, for example a carbonaceous reducing agent, e.g. coke, or iron is also charged into such furnace in an amount sufficient to reduce the oxides of antimony and lead, $Sb_2O_3$ and PbO, to metallic antimony and metallic lead. The slag and reducing agent are heated therein to a reaction temperature, which is an elevated temperature usually in the range of about 600° C. to about 800° C., and a forced blast of air is passed through the reaction mass in the cupola furnace, whereby the oxides of antimony, and lead are reduced to metallic antimony and metallic lead. The thus-obtained molten metal contains, by weight, typically about 25% metallic antimony, balance substantially all metallic lead.

The antimony can be separated from the lead by treating the molten Pb-Sb alloy with chlorine gas supplied through a tube or lance immersed in the molten alloy pool, or otherwise. The $Cl_2$ reacts selectively with the Pb to form $PbCl_2$ which separates as a separate phase layer on the surface of the pool of molten Sb. The $PbCl_2$-containing layer is readily separated from the molten Sb, for instance by skimming from molten Sb pool surface.

Alternatively, the antimony can be separated from the molten lead by electrolysis.

The metallic alkali metal utilizable herein as reducing agent is exemplified by metallic sodium, potassium and lithium.

BRIEF DESCRIPTION OF THE DRAWING

The accompanying drawing is a schematic flow diagram of the process in accordance with one embodiment of the invention.

DETAILED DESCRIPTION

In one embodiment of the invention, with reference to the drawing, molten lead bullion from the blast furnace is liquated in steel kettle 5 in conventional manner by cooling to a temperature of the bullion of about 425° C.–455° C. A copper-containing dross separates from the molten bullion on the surface of the bullion as a result of the liquating, and this dross is separated from the molten bullion, for instance by skimming. The copper-containing dross, also known as rough dross or de-copperizing dross, may be transferred to a dross reverberatory furnace and smelted therein in conventional manner with coke and soda ash to produce copper matte, speiss and lead. The lead can be returned to the molten liquated bullion in kettle 5.

Metallic sodium is added as reducing agent to the molten liquated lead in kettle 5. The metallic sodium is added to the molten rough drossed lead bullion in an amount sufficient to reduce a major portion, i.e. in excess of 50%, all or substantially all of the antimony of the sulfo-antimony compound of copper to zero valent metallic antimony. The alloying of the metallic sodium with the molten lead in kettle 5 generates substantial heat.

Tetrahedrite ore concentrate is added to the molten lead pool in kettle 5 equipped with external heating means (not shown), such as a burner, usually by being charged onto the top surface of the molten lead pool. One formula for tetrahedrite is $3Cu_2S.Sb_2S_3$. The tetrahedrite ore concentrate, which usually also contains silver, is ordinarily added to the molten lead pool in fine, particulate form, usually in powder form of particle size of typically −20 mesh. A rapid chemical reaction occurs upon the addition of such ore concentrate to the molten lead containing the metallic sodium, and the melt turns a glowing red and becomes very fluid. The melt plus the metallic sodium and the tetrahedrite ore concentrate is stirred by means of a conventional propeller mixer, which mixer produces a vortex in the molten metal, and reacted for a period of typically about 5–15 minutes, whereby the metallic sodium exothermically selectively reduces the antimony from the tetrahedrite as metallic antimony, and the thus-liberated, reduced metallic antimony dissolves in the molten lead of the pool. By reason of the heat generated in the molten lead pool due to the mixing or alloying of the metallic sodium with the lead, and the additional heat imparted to the melt pool by the exothermic reduction of antimony of the tetrahedrite by the sodium, at most little external heat is required to be added to the melt pool. A major portion, i.e. more than 50%, of the silver present in the tetrahedrite also dissolves in the molten lead of the pool. A low-melting matte phase searates out on the surface of the molten lead pool. The matte is formed by the reaction of the alkali sulfide, e.g. $Na_2S$ (formed by the reduction of the antimony by the metallic alkali metal, e.g. metallic sodium) with the $Cu_2S$ of the tetrahedrite to form a low melting matte comprising a sulfoalkali compound of copper, e.g. $Na_2S.Cu_2S$. A relatively small or minor portion, i.e. less than 50%, of the silver present in the tetrahedrite, also passes into the matte. The matte has a melting point of the order of about 500° C. The reaction for the reduction of the antimony in the tetrahedrite to zero valent metallic antimony and the formation of the matte can be represented by the following equation:

$$6Alk_{Pb}+3Cu_2S.Sb_2S_3 \rightarrow 2Sb_{Pb}+3(Alk_2S.Cu_2S)$$

wherein Alk is metallic alkali metal.

The matte phase layer is separated from the surface of the molten lead pool containing the liberated metallic antimony.

The antimony can be recovered from the molten lead, for instance by one of the procedures previously disclosed herein for separating the antimony from the lead. Alternatively the antimony can be retained in the lead if a lead-and antimony-containing alloy is desired, also as previously disclosed herein.

DESCRIPTION OF THE PREFERRED EMBODIMENTS

Metallic sodium is the preferred alkali metal for use herein.

Preferably the metallic alkali metal is added to the molten lead pool prior to the tetrahedrite ore concentrate or other material containing the sulfo-antimony compound of copper.

The preferred temperature of the molten lead pool during the addition of the metallic alkali metal and the material containing the sulfo-antimony compound of copper thereto, such as tetrahedrite ore concentrate, is in the range of from about 400° C. to 650° C.

The following examples further illustrate the invention:

EXAMPLE I

Four-thousand five-hundred and forty (4540) g of corroding lead was melted and held at 600° C. in a stainless steel crucible. Metallic Na was added in 3 batches, totaling 100 g, to this molten pool of lead, and the Na rapidly dissolved into the molten lead. The temperature of the molten lead pool increased about 100° C. due to the exothermic heat of solution of the Na in the lead.

As soon as the Na had dissolved in the lead, a total of 681 g of tetrahedrite was charged onto the molten pool surface in the crucible. The tetrahedrite was in particulate form and of −3+20 sieve size. The tetrahedrite contained, by weight, 27.4% Cu, 15.2% Sb, 14.7% Fe, 2.5% Pb, 26.9% S, 2.5% Ag and 2.8% As. The mixture of molten lead, metallic Na and tetrahedrite was vigorously stirred in the crucible and a red, molten matte phase ($Na_2S.Cu_2S$) formed on the surface of the molten lead pool. The metallic Na reduced the combined antimony in the tetrahedrite to zero valent Sb metal which dissolved in the molten lead. Stirring was continued for 5 minutes, and the extremely fluid matte was then skimmed from the surface of the melt pool, weighed and analyzed. 830 g of matte was skimmed, and the matte had the following analysis, by weight: 18.7% Cu, 0.21% Sb, 12.0% Fe, 30.6% Pb, 18.2% S, 0.19% Ag, 0.35% As and 9.5% Na.

The antimony metal can be recovered from the molten lead in this Example I and in Examples II through V which follow by any of the procedures disclosed previously herein for separating metallic antimony from the lead. Also, Ag can be recovered from the molten lead in this Example I and in Example II through V which follow by any conventional procedure for recovering Ag from lead.

EXAMPLE II

Forty-seven thousand five-hundred (47,500) g of corroding lead was melted by heating at 400° C. in a steel kettle. The molten lead was then stirred with a stirrer with a good vortex, and a total of 1000 g of metallic Na was added in small increments to the molten lead pool over a period of several minutes. After the alloying of the lead with the metallic Na was completed, the temperature of the molten pool increased to 538° C. and the entire 6,800 g charge of tetrahedrite was added onto the molten pool surface in the kettle. Stirring of the molten pool was begun to facilitate contact of the tetrahedrite concentrate with the molten Na-Pb alloy. A slow rate of stirring of about 100 rpm without a vortex was maintained for a few minutes to avoid dusting of the tetrahedrite concentrate. The tetrahedrite concentrate of the charge contained, by weight, 27.4% Cu, 15.2% Sb, 2.8% Pb, 2.5% As, 26.9% S, 14.3% Fe, 0.7% Zn and 0.1% Na.

The temperature of the molten pool further increased, and when its temperature reached 1200° F. after about 10 minutes, a reddish brown matte phase ($Na_2S.Cu_2S$) was observed to form about the stirrer. The metallic Na reduced the combined antimony in the tetrahedrite to zero valent Sb metal which dissolved in the molten lead. In a short time, the reddish brown matte phase was substantially fully formed and with the temperature of the molten pool at 675° C., the speed of stirring the pool was increased so as to draw a vortex. The stirring was maintained for 10 minutes, stopped, and the stirrer removed.

The extremely fluid matte was then skimmed from the surface of the pool, weighed and analyzed. 6,650 g. of matte had been skimmed, and the matte had the following analysis, by weight: 19.5% Cu, 0.14% Sb, 15.6% Pb, 0.13% Ag, 22.4% S, 16.0% Na, 0.33% As, 15.4% Fe and 0.75% Zn. 82.8% of the Cu reported in the matte. The lead bullion remaining after skimming off the matte, which lead bullion totaled about 46,950 g., was analyzed. 99.0% of the Sb reported in the lead, and 94.8% of the Ag reported in the lead.

EXAMPLE III

The procedure of Example II was repeated employing substantially identical temperatures and reaction conditions in this Example III as were employed in Example II. However, in this Example III, the tetrahedrite concentrate charged onto the molten pool surface was a so-called "high lead" tetrahedrite concentrate of the following composition, by weight: 20.1% Cu, 13.6% Sb, 19.4% Pb, 2.1% Ag, 1.8% As, 24.1% S, 10.0% Fe, 3.3% Zn and 0.1% Na. Also, in this Example III, 46,000 g. of corroding lead was melted in the kettle to form the molten lead pool to which the metallic Na was added.

68,000 g. of matte was skimmed from the molten pool surface, the matte having the following analysis, by weight, 19.1% Cu, 0.3% Sb, 18.8% Pb, 0.16% Ag, 20.1% S, 12.0% Na, 0.2% As, 11.2% Fe and 1.9% Zn. 82.4% of the Cu reported in the matte. 98.3% of the Sb reported in the lead, and 93.3% of the Ag reported in the lead.

EXAMPLE IV

Twenty-seven thousand seven-hundred (27,700) lbs. of refined lead was melted by heating at about 450° C. in a steel kettle. The refined lead contained, by weight, 0.0003% Sb, 0.0005% Ag, 0.0005% Cu, and <0.0001% Ag. The molten lead was stirred with a stirrer to provide a good vortex, and a total of 560 lbs. of metallic Na was added to the molten lead pool in 12 lb. bricks of metallic Na, 1 brick at a time and continuously. The temperature of the molten pool increased to 650° C. 4100 lbs. of tetrahedrite was charged onto the surface of the molten lead pool. The tetrahedrite contained, by weight, 27.1% Cu, 16.9% Sb, 26.7% S, 3.3% As, 2.4% Pb and 735 g. of Ag per ton. The molten pool was then stirred for about 1 hour, and a reddish brown matte phase ($Na_2S.Cu_2S$) formed on the surface of the molten pool. The metallic Na reduced the combined antimony in the tetrahedrite to zero valent Sb metal which dissolved in the molten lead. The stirring was discontinued after about 1 hour.

The extremely fluid matte was skimmed from the surface of the molten pool, weighed and analyzed. 2790 lbs. of matte had been skimmed, and the matte had the following analysis, by weight: 21.1% Cu, 17.1% Pb, 0.18% Sb, 0.14% As, 23.9% S, 16.3% Na and 26.3 g. of Ag per ton. 78.5% of the Cu reported in the matte. The lead bullion remaining after the skimming totaled about 31,000 lbs., and this lead was analyzed. 99.0% of the Sb reported in the lead, and 97.7% of the Ag reported in the lead.

EXAMPLE V

One-hundred and seventy-one thousand (171,000) lbs. of lead bullion was melted by heating at about 450° C. in a steel kettle. The lead bullion contained, by weight, 2.08% Sb, 0.02% Cu, 0.21% As and 220 oz. of Ag per ton of molten metal. The molten lead was stirred with a stirrer to provide a good vortex, and a total of 3200 lbs. of metallic Na was added to the molten bullion pool in 12 lb. bricks of metallic Na 1 brick at a time and continuously. The temperature of the molten bullion pool increased to about 585° C. 24,400 lbs. of tetrahedrite was charged onto the surface of the molten bullion pool. The tetrahedrite contained, by weight: 16.9% Sb, 27.1% Cu, 3.3% As, 26.7% S, 2.4% Pb and 735 oz. of Ag per ton. The molten bullion pool was then stirred for about 1½ hours, and a reddish brown matte phase ($Na_2S.Cu_2S$) formed on the surface of the molten pool. The metallic Na reduced the combined antimony in the tetrahedrite to zero valent Sb metal which dissolved in the molten lead. The stirring was discontinued after 1½ hours. The extremely fluid matte was skimmed from the surface of the molten pool, weighed and analyzed. 22,000 lbs. of matte had been skimmed, and the matte had the following analysis, by weight: 0.39% Sb, 19.3% Cu, 0.58% As, 17.7% Pb, 21.4% S, 14.8% Na and 100 oz. of Ag per ton. The lead bullion remaining after the skimming totaled 172,200 lbs., and this lead bullion was analyzed. 98.7% of the Sb reported in the lead bullion, and 95.7% of the Ag reported in the lead bullion.

What is claimed is:

1. A process for separating antimony values from a material containing a sulfo-antimony compound of copper without the use of a reverberatory or blast furnace which comprises:

(a) establishing a pool of molten lead;

(b) adding metallic alkali metal to the molten lead pool in an amount sufficient to reduce the desired amount of combined antimony in the sulfo-antimony compound of copper to metallic antimony;

(c) adding the material containing the sulfo-antimony compound of copper to the molten lead pool;

(d) mixing together the metallic alkali metal, molten lead, and material containing the sulfo-antimony compound of copper whereupon the metallic alkali metal reacts with the material containing the sulfo-antimony compound of copper to reduce the combined antimony therein to zero valent, elemental antimony;

(e) forming a low melting copper sulfide-alkali metal sulfide matte phase which separates from the molten lead pool;

(f) passing the liberated metallic antimony into the molten lead pool; and (g) separating the low melting matte phase from the pool containing the antimony.

2. The process of claim 1 wherein the metallic alkali metal is added to the molten lead prior to the addition of the material containing the sulfo-antimony compound of copper.

3. The process of claim 1 wherein the temperature of the molten lead pool, during the addition thereto of the metallic alkali metal and the material containing the sulfo-antimony compound of copper, is not in excess of 650° C.

4. The process of claim 3 wherein the temperature of the molten lead pool is in the range from about 400° C. to 650° C.

5. The process of claim 2 wherein the metallic alkali metal is sodium.

6. The process of claim 1 wherein the antimony is recovered from the molten lead.

7. The process of claim 6 wherein the antimony is recovered from the molten lead by electrolysis.

8. The process of claim 1 wherein the material containing the sulfo-antimony compound of copper is tetrahedrite ore concentrate.

9. The process of claim 2 wherein the material containing the sulfo-antimony compound of copper is tetrahedrite ore concentrate.

10. The process of claim 1 wherein the molten lead pool, alkali metal and sulfo-antimony compound of copper are brought together in a kettle and heated therein.

11. The process of claim 1 wherein the amount of alkali metal added is sufficient to reduce substantially all the antimony of the sulfo-antimony compound to zero valent metallic antimony.

12. The process of claim 1 wherein the formed matte phase has a melting point of about 500° C.

* * * * *